US012714160B2

(12) United States Patent
Rankine et al.

(10) Patent No.: US 12,714,160 B2
(45) Date of Patent: Aug. 25, 2026

(54) ADJUSTABLE GARMENT

(71) Applicant: Acushnet Company, Fairhaven, MA (US)

(72) Inventors: Brock D. Rankine, New Bedford, MA (US); Peter J. Skurla, III, Bridgewater, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/969,646

(22) Filed: Dec. 5, 2024

(65) Prior Publication Data

US 2026/0157451 A1 Jun. 11, 2026

(51) Int. Cl.
*A41D 1/06* (2006.01)
*A41F 9/00* (2006.01)

(52) U.S. Cl.
CPC . *A41D 1/06* (2013.01); *A41F 9/00* (2013.01)

(58) Field of Classification Search
CPC .. A41F 9/025; A41F 9/02; A41F 11/16; A41F 9/002; A41D 1/06; A41D 1/21; A41D 1/14; A41D 2200/10; A41C 1/003; A41C 1/08; A61F 13/496; A61F 13/5655; A41B 9/008; A41B 9/14; A41B 9/001
See application file for complete search history.

(56) References Cited

U.S. PATENT DOCUMENTS

| | | | | |
|---|---|---|---|---|
| 1,225,613 | A * | 5/1917 | Geiger | A41F 9/025 2/221 |
| 1,642,483 | A | 9/1927 | Bloomenthal | |
| 2,988,112 | A * | 6/1961 | Horowitz | D03D 15/56 139/55.1 |
| 3,098,238 | A | 7/1963 | Diamond | |
| 3,204,253 | A | 9/1965 | Sato | |
| 6,880,175 | B2 * | 4/2005 | Tajima | A41F 9/025 2/221 |
| 9,247,776 | B1 * | 2/2016 | Kim | A41D 27/205 |
| 2007/0067889 | A1 * | 3/2007 | Spiewak | A41D 27/20 2/69 |
| 2013/0212779 | A1 | 8/2013 | Dowling et al. | |
| 2017/0188641 | A1 * | 7/2017 | Bell | A41D 13/0568 |
| 2020/0352267 | A1 * | 11/2020 | Lazic | A41D 27/201 |

FOREIGN PATENT DOCUMENTS

| | | | | |
|---|---|---|---|---|
| GB | 742688 A * | 12/1955 | | A41F 9/025 |

* cited by examiner

*Primary Examiner* — Grady Alexander Nunnery

(57) ABSTRACT

An article comprising a lower garment with a front left waistband and a front right waistband, a back waistband, a left side panel provided between the front left waistband and a left side edge of the back waistband, a right side panel provided between the front right waistband and a right side edge of the back waistband, and one or more extendable flaps with a first end attached to the front left or right waistband and a second end that is securable to the left or right side panel.

19 Claims, 12 Drawing Sheets

ADJUSTABLE GARMENT

BACKGROUND

Various articles of apparel may be worn by a subject to cover and/or protect the subject's body from external environmental conditions and/or climates. The articles of apparel worn by the subject can directly or indirectly affect or influence the comfort, mental state, and/or physical abilities of a subject wearing the articles of apparel.

SUMMARY

In one aspect, the present disclosure provides various non-limiting examples of articles of apparel with adjustable constructions. The adjustable constructions may allow a subject to adjust the fit of the one or more articles of apparel to (i) improve the subject's mobility or ability to perform various different actions or movements, (ii) enhance the wearing comfort of the articles of apparel, (iii) adjust the aesthetic profile of the articles of apparel, and/or (iv) better protect the subject's body from external conditions and/or climates.

In some embodiments, the articles of apparel may comprise a lower garment with an adjustable waist band. In some cases, the lower garment may comprise (i) a front left waistband and a front right waistband; (ii) a back waistband; (iii) a left side panel provided between the front left waistband and a left side edge of the back waistband; (iv) a right side panel provided between the front right waistband and a right side edge of the back waistband; and (v) one or more extendable flaps with a first end attached to the front left or right waistband and a second end that is securable to the left or right side panel.

In some cases, a first fastener may be provided on the left side panel or the right side panel. In some cases, the second end of the one or more extendable flaps may comprise a second fastener configured to engage the first fastener. In some cases, the second fastener may be positioned along an underside of the one or more extendable flaps.

In some cases, the left or right side panel may comprise a first front edge portion attached to the front left or right waistband and a second front edge portion extending along a pocket opening of the lower garment. In some cases, the left or right side panel may comprise a back edge portion attached to the back waistband and one or more rear panels of the lower garment.

In some cases, the left or right side panel may comprise (i) an anterior section positioned entirely below the front left or right waistband and (ii) a posterior section configured to extend to an uppermost edge of the lower garment. In some cases, the anterior section may comprise a first upper edge and the posterior section may comprise a second upper edge that is offset from the first upper edge. In some cases, the anterior section may comprise a first front edge and the posterior section may comprise a second front edge that is offset from the first front edge.

In some cases, the lower garment may comprise one or more side pockets with pocket openings disposed along the first front edge of the anterior section. In some cases, the lower garment may comprise a fastener configured to open and/or close the pocket openings of the one or more side pockets. In some cases, the lower garment may comprise one or more pocket welts overlapping at least a portion of the anterior section. In some cases, the fastener may be provided under the one or more pocket welts of the lower garment. In some cases, a lower portion of the pocket welts may be perforated to drain water caught in the one or more pocket welts or between the one or more pocket welts and one or more other layers or panels of the lower garment.

In some cases, the left or right side panel may comprise an elastic material. In some cases, the left or right side panel may comprise an inelastic material.

In some cases, the extendable flaps may comprise an elastic material. In some cases, the extendable flaps may comprise an inelastic material.

In some cases, the back waistband may comprise one or more elastic regions encased within the back waistband. In some cases, the back waistband may comprise a gripper elastic portion provided along an inner surface of the back waistband.

Additional aspects and advantages of the present disclosure will become readily apparent to those skilled in the art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

Non-limiting and non-exhaustive examples of the various embodiments disclosed herein are described with reference to the following figures.

DETAILED DESCRIPTION

Articles of Apparel

Figure 1:
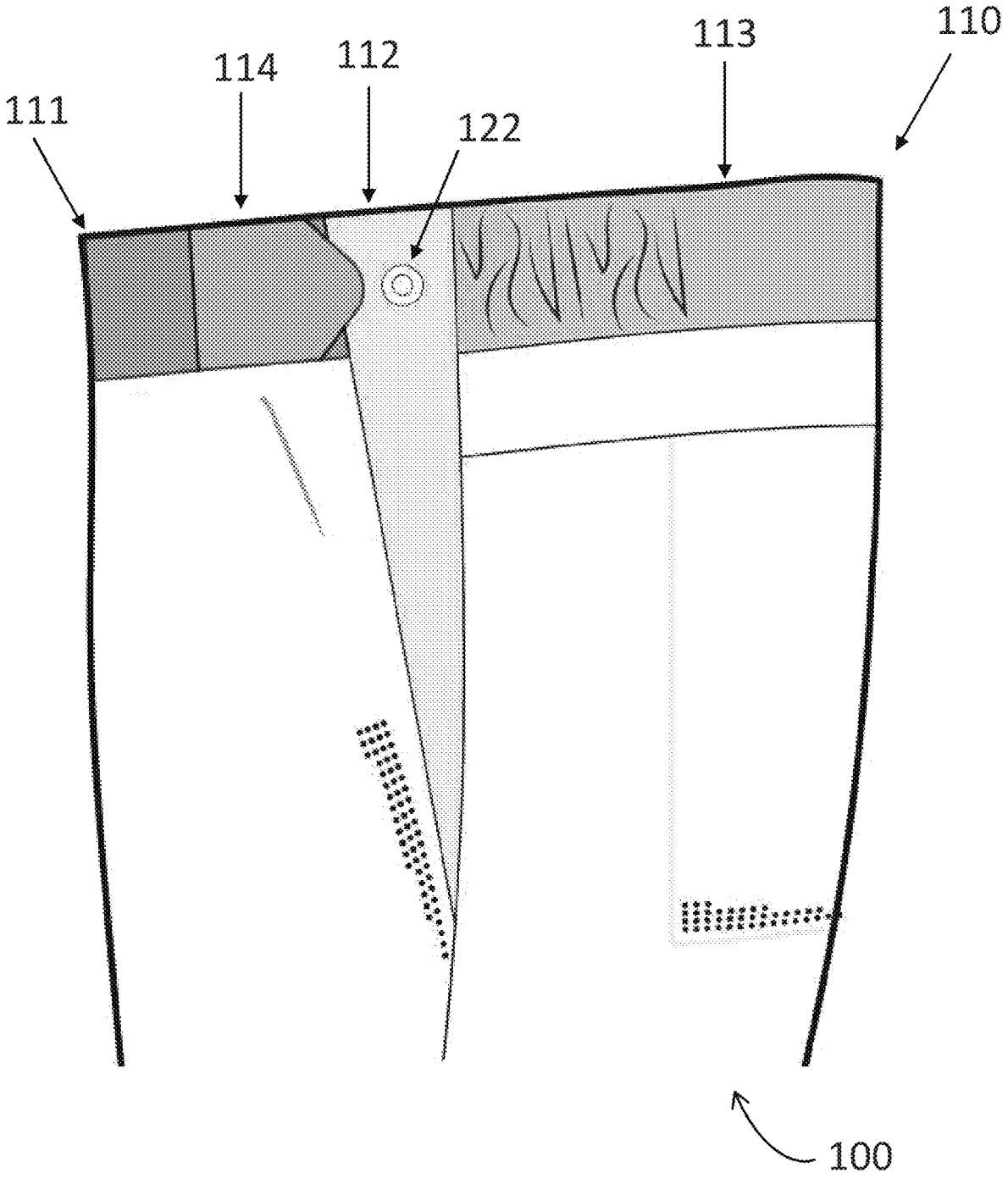
FIG. 1 schematically illustrates an example of a lower garment with an adjustable waistband construction, in accordance with some embodiments.

In an aspect, the present disclosure provides various articles of apparel that are adjustable to fit and/or conform to a subject's body. In some embodiments, the articles of apparel may comprise a garment.

In some non-limiting embodiments, the garment may include a lower garment. The lower garment may include, for example, a pant, a trouser, shorts, leggings, or any other type of garment that can be worn to cover a subject's legs, hip, waist, midsection, or lower body. In some embodiments, the lower garment may comprise a garment configured to cover or surround at least a lower portion of a subject's body. In some embodiments, the lower portion of the subject's body may include, for example, a hip region, a waist region, a thigh region, an upper leg region, a lower leg region, a calf region, and/or an ankle region of the subject's body.

In other non-limiting embodiments, the garment may include an upper garment. The upper garment may include, for example, a shirt, a top, a sweater, a jacket, an outer layer, a mid-layer, a base layer, or any other type of garment that can be worn to cover at least an upper portion of a subject's body. In some cases, the upper portion of the subject's body may include, for example, a neck region, a shoulder region, an arm region, a back region, a chest region, a torso region, an abdominal region, a side region, and/or an upper or lower midsection of the subject's body. In some cases, the upper portion of the subject's body may optionally include a waist portion (e.g., an upper waist portion and/or a lower waist portion) of the subject's body.

In some embodiments, the articles of apparel disclosed herein may be worn by a subject engaging or participating in one or more activities. In some embodiments, the one or more activities may comprise a physical activity (e.g., walking, jogging, running, golfing, etc.). In some embodiments, the one or more activities may comprise a non-physical activity (e.g., standing, sitting, resting, lying down, etc.) or any activity that either involves minimal movement or does not involve active movement. In some non-limiting embodiments, the one or more activities may involve one or more golf-related actions or movements performed on or near a golf course or another location proximal to a golf course.

Adjustable Construction

In one aspect, the present disclosure provides an article of apparel with an adjustable construction. In some cases, the adjustable construction may be adjusted to optimize the sizing and/or the overall fit of the article of apparel. In some cases, the adjustable construction may be adjusted to enhance the subject's mobility and/or the subject's ability to perform various actions or movements in different environments. In some cases, the adjustable construction may be adjusted to better protect the subject's body from external conditions or climates. In some cases, the adjustable construction may be adjusted to enhance the wearing comfort and/or the visual appearance of the article of apparel.

Adjustable Waistband

In some embodiments, the articles described herein may comprise a garment with an adjustable waist band. In some cases, the adjustable waist band may be configured to extend around a subject's waist when the subject positions the garment around the subject's lower body. In some cases, the adjustable waist band may be configured to stretch or expand and adapt and/or conform to the size and/or shape of the subject's body.

FIG. 1 schematically illustrates an example of an article of apparel with an adjustable construction. In some embodiments, the article of apparel may comprise a lower garment 100. In some cases, the lower garment 100 may comprise an adjustable waist band 110.

In some embodiments, the adjustable waist band 110 may comprise a front waistband portion 111. In some cases, the front waistband portion 111 may include a front left waistband and a front right waistband.

In some embodiments, the lower garment may comprise one or more side panels 112. In some cases, the one or more side panels 112 may be attached or coupled to the front left waistband and/or the front right waistband.

In some embodiments, the adjustable waist band 110 may further comprise a back waistband 113. In some cases, the back waistband 113 may be attached or coupled to the one or more side panels 112.

In some embodiments, the adjustable waist band 110 may comprise one or more extendable flaps 114. In some cases, the one or more extendable flaps 114 may be attached or coupled to the front left waistband and/or the front right waistband. In some cases, the one or more extendable flaps 114 may be releasably coupled or secured to the one or more side panels 112 to adjust the sizing of the waistband and/or the amount of tension in the waistband.

Front Waistband

Figure 2:
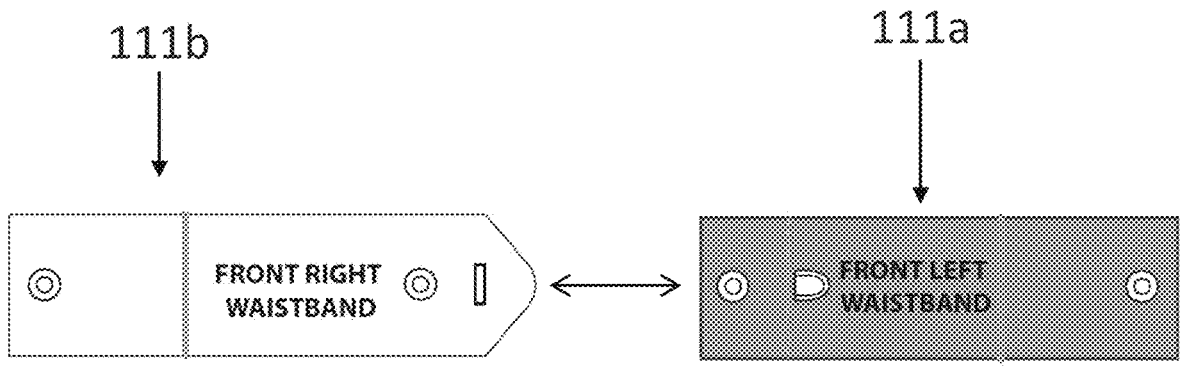
FIG. 2 schematically illustrates a front right and left waistband of the lower garment, in accordance with some embodiments.

Referring to FIG. 2, in some cases, the front waistband portion 111 of the adjustable waist band 110 may comprise a front left waistband 111*a*. In some cases, the front left waistband 111*a* may be configured to extend along a front left side of a subject's waist or lower body. In some cases, the front left waistband 111*a* may be configured to extend between a front center portion of the lower garment and a left side portion of the lower garment.

In some cases, the front waistband portion 111 of the adjustable waist band 110 may comprise a front right waistband 111*b*. In some cases, the front right waistband 111*b* may be configured to extend along a front right side of a subject's waist or lower body. In some cases, the front right waistband 111*b* may be configured to extend between a front center portion of the lower garment and a right side portion of the lower garment.

In some cases, the front left waistband 111*a* and the front right waistband 111*b* may be releasably coupled to each other using one or more fasteners. In some cases, the one or more fasteners may include (i) a fastener disposed on the front left waistband or the front right waistband. In some cases, the one or more fasteners may include (ii) another fastener disposed on the front right waistband or the front left waistband. In some cases, the fasteners may comprise a set of complementary fasteners. In some cases, the fasteners may include a button, a snap fit, a buckle, a hook, a loop, a hook and loop fastener (e.g., Velcro®), a clip, a latch, a clasp, a ring, a zipper mechanism, a lacing system, or any other type of mechanical fastener.

Extendable Flaps

Figure 3:
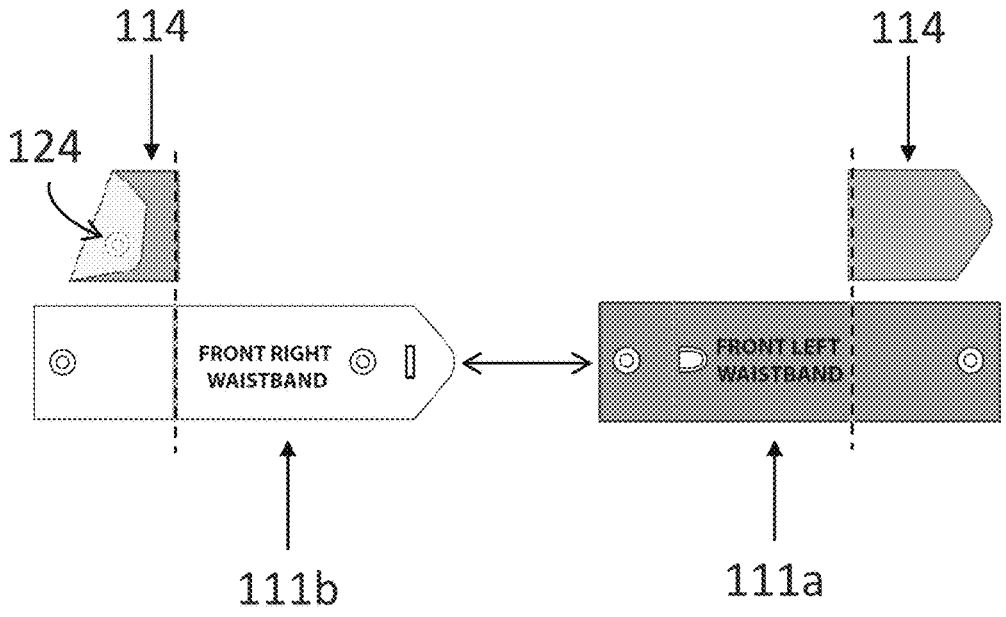
FIG. 3 schematically illustrates one or more extendable flaps that can be attached to the front right and/or left waistband, in accordance with some embodiments.

Referring to FIG. 3, in some cases, the adjustable waist band 110 may comprise one or more extendable flaps 114. In some cases, the one or more extendable flaps 114 may comprise (i) a first end attached to the front left waistband or the front right waistband and (ii) a second end that is securable to another portion of the front left and/or right waistbands. In some cases, the one or more extendable flaps 114 may comprise (i) a first end attached to the front left waistband or the front right waistband and (ii) a second end that is securable to the one or more side panels.

In some cases, the first end of the one or more extendable flaps may be fixed to the front right and/or left waistbands. In some cases, the second end of the one or more extendable flaps may be releasably coupled to (i) the front right and/or left waistbands and/or (ii) the side panels of the lower garment.

In some cases, the second end of the one or more extendable flaps may be releasably coupled to different portions of the waistband to adjust the sizing of the waistband and/or the amount of tension in the waistband. In some cases, the waistband may have a first length or a first amount of tension when the second end of the one or more extendable flaps is secured to a first portion of the waistband (e.g., to the front right and/or left waistbands). In some cases, the waistband may have a second length or a second amount of tension when the second end of the one or more extendable flaps is secured to a second portion of the waistband (e.g., to the left and/or right side panels).

In some cases, the second end of the one or more extendable flaps 114 may comprise a fastener 124. In some cases, the fastener 124 may be positioned along an underside of the one or more extendable flaps 114. In some cases, the fastener 124 may be positioned towards the second end of the extendable flaps. In some cases, the fastener 124 may be configured to engage another fastener provided on the front right waistband and/or the front left waistband. In some cases, the fastener 124 may be configured to engage another fastener provided on the one or more side panels.

In some cases, the one or more extendable flaps may comprise an elastic material or one or more elastic sections or regions. In some cases, the one or more extendable flaps may comprise an inelastic material or one or more inelastic sections or regions. In some cases, the one or more extendable flaps may comprise one or more elastic materials and/or one or more inelastic materials. In some cases, the one or more extendable flaps may comprise one or more elastic sections or regions and/or one or more inelastic sections or regions.

Side Panels

Figure 4:
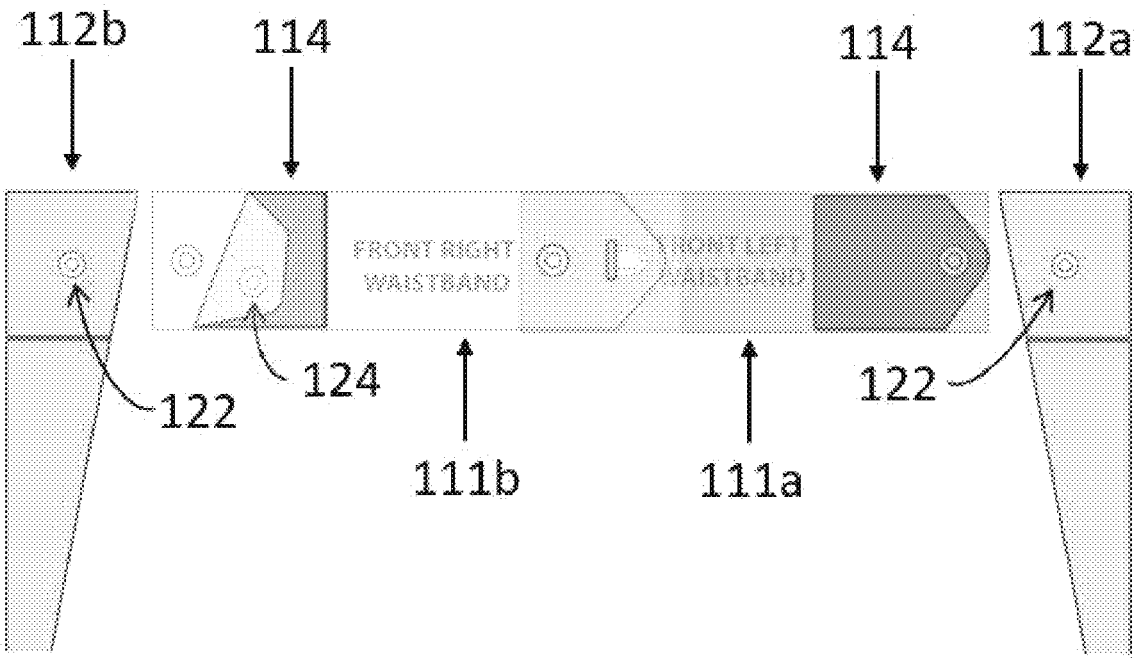
FIG. 4 schematically illustrates one or more side panels with a fastener, in accordance with some embodiments.
Figure 5:
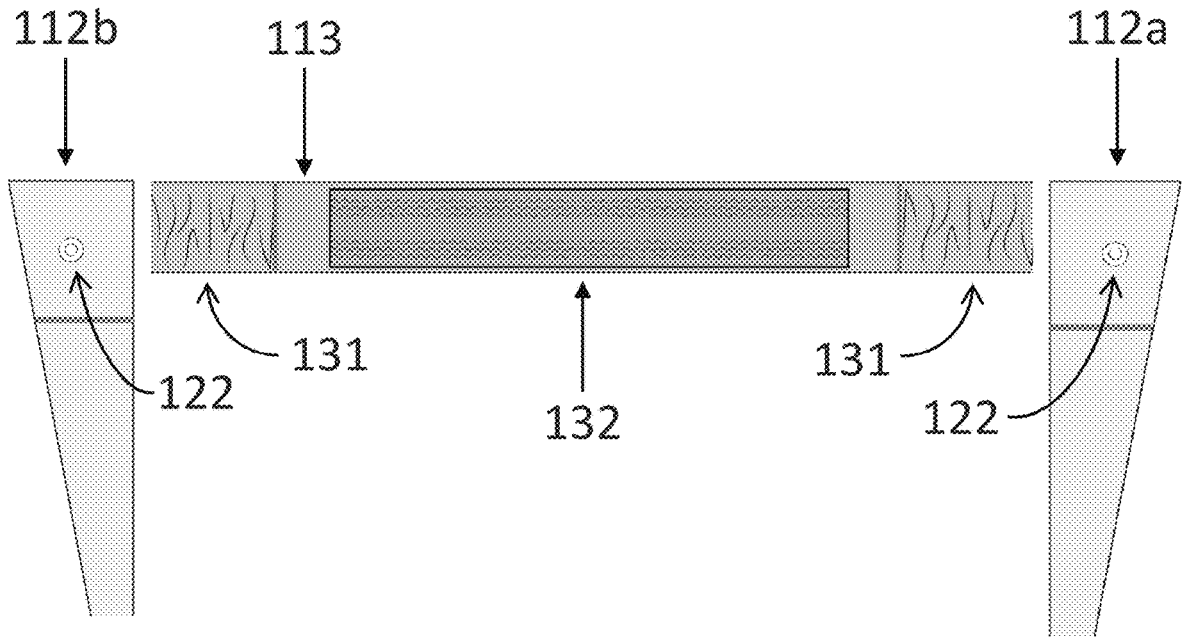
FIG. 5 schematically illustrates a back waistband that can be attached to one or more side panels of the lower garment, in accordance with some embodiments.

Referring to FIGS. 4 and 5, in some cases, the one or more side panels 112 may comprise a left side panel 112*a* provided between the front left waistband 111*a* and a left side edge of the back waistband 113. In some cases, the one or more side panels 112 may comprise a right side panel 112*b* provided between the front right waistband 111*b* and a right side edge of the back waistband 113.

In some cases, the left and/or right side panel may comprise an elastic material or one or more sections comprising an elastic material. In some cases, the left and/or right side panel may comprise an inelastic material or one or more sections comprising an inelastic material.

In some cases, one or more fasteners 122 may be provided on the left and/or right side panel. In some cases, the one or more fasteners 122 may comprise a fastener centered on an upper portion of the left side panel and/or the right side panel. In some cases, the fastener may be configured to engage another fastener 124 provided along the underside of the one or more extendable flaps 114.

Back Waistband

FIG. 5 schematically illustrates a back waistband 113 of the adjustable waist band. In some cases, the back waistband 113 may be opposite the front left waistband and the front right waistband. In some cases, the back waistband 113 may be configured to extend along and/or around a back side of a subject's waist or lower body. In some cases, the back waistband 113 may be configured to extend between a left side portion and a right side portion of the lower garment. In some cases, the back waistband 113 may be configured to extend from a left side portion of the lower garment to a right side portion of the lower garment, or from a right side portion of the lower garment to a left side portion of the lower garment.

In some cases, the back waistband 113 may be attached or coupled to the one or more side panels 112 of the lower garment. In some cases, a left side edge of the back waistband 113 may be attached or coupled to a back edge portion of the left side panel 112*a* of the lower garment. In some cases, a right side edge of the back waistband 113 may be attached or coupled to a back edge portion of the right side panel 112*b* of the lower garment.

In some cases, the back waistband 113 may comprise one or more elastic regions configured to stretch and/or expand under tension. In some cases, the one or more elastic regions may include one or more encased elastic elements 131 arranged along the left and/or right side edges of the back waistband 113. In some cases, the back waistband 113 may comprise one or more non-elastic regions configured to resist stretching or expansion under tension.

In some cases, the back waistband 113 may comprise an elastic gripper element 132. In some cases, the elastic gripper element 132 may be disposed along an inner surface portion of the back waistband 113. In some cases, the elastic gripper element 132 may comprise a material that can frictionally engage another article of apparel worn by the subject in order to control or limit (i) a movement of the waistband or the lower garment relative to the other article of apparel or (ii) a movement of the other article of apparel relative to the waistband or the lower garment.

Waist Band Adjustment

The adjustable waistband constructions shown in FIGS. 1-5 may be manipulated by a subject to adjust the sizing of the waistband and/or the amount of tension in the waistband, so that the lower garment fits comfortably around the subject's waist and lower body. In some cases, the front left waistband and the front right waistband may be secured together around the subject's waist (e.g., using a first set of fasteners) to initially secure the lower garment around the subject's waist or lower body. In some cases, the ends of the extendable flaps 114 may be detachably coupled to the front left and/or right waistbands (e.g., using a second set of fasteners). In some cases, the ends of the extendable flaps 114 may be released from the front waistband(s) by disengaging the second set of fasteners, so that the extendable flaps can be extended towards the side panels of the lower garment. In some cases, the extendable flaps 114 may be extended towards the side panels and releasably coupled to one or more fasteners provided on the side panels. In some cases, when the extendable flaps 114 are secured to the side panels, the circumferential length of the adjustable waistband may be decreased. In some cases, when the extendable flaps 114 are secured to the side panels, the adjustable waistband may be more tightly secured around the subject's waist or lower body.

In some cases, when a subject wishes to (i) increase the circumferential length of the adjustable waistband or (ii) release the tension in the waistband, the subject may disengage the fasteners coupling the extendable flaps to the side panels. Once the extendable flaps are released, the free ends of the extendable flaps may be repositioned towards one or more fasteners provided on the front right and/or left waistbands, and the fasteners provided along the underside of the extendable flaps may be detachably coupled to the fasteners provided on the front right and/or left waistbands. In some cases, when the extendable flaps are secured to the front right waistband and/or the front left waistband, the upper and lower edges of the extendable flaps may be neatly arranged along or parallel to the upper and/or lower edges of the front right and/or left waistbands to preserve the aesthetic profile of the adjustable waistband. In some cases, the extendable flaps may be configured to remain in a fixed position and/or a fixed orientation relative to the rest of the waistband when the extendable flaps are secured to the front right and/or left waistbands. In some cases, securing the extendable flaps to the front right and/or left waistbands may prevent the extendable flaps from hanging downwards and moving around unnecessarily when the flaps are not in use. In some cases, when the extendable flaps are not in use, the extendable flaps may be secured to the front right and/or left waistbands so that the extendable flaps are positioned out of the way and do not interfere with the subject's mobility, comfort, or ability to execute various different actions or movements.

Side Panel Configurations

Figure 6:
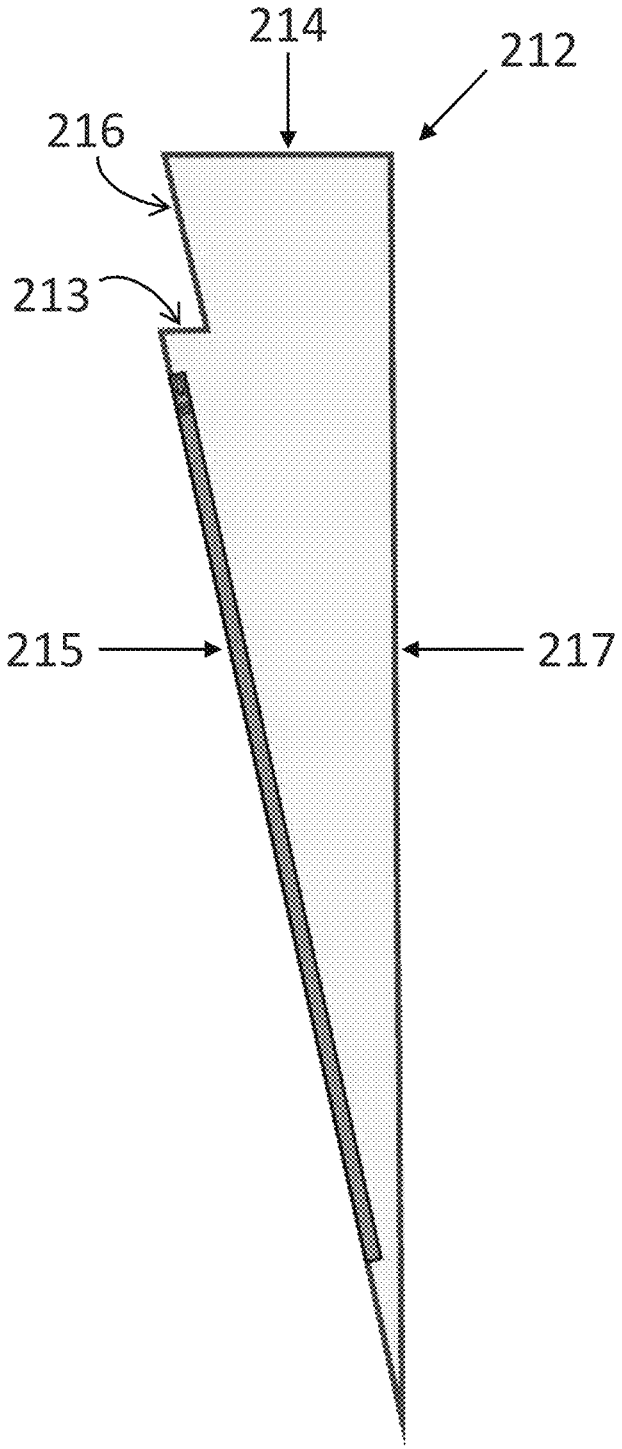
FIG. 6 schematically illustrates a detailed view of a side panel construction for a lower garment, in accordance with some embodiments.
Figure 7:
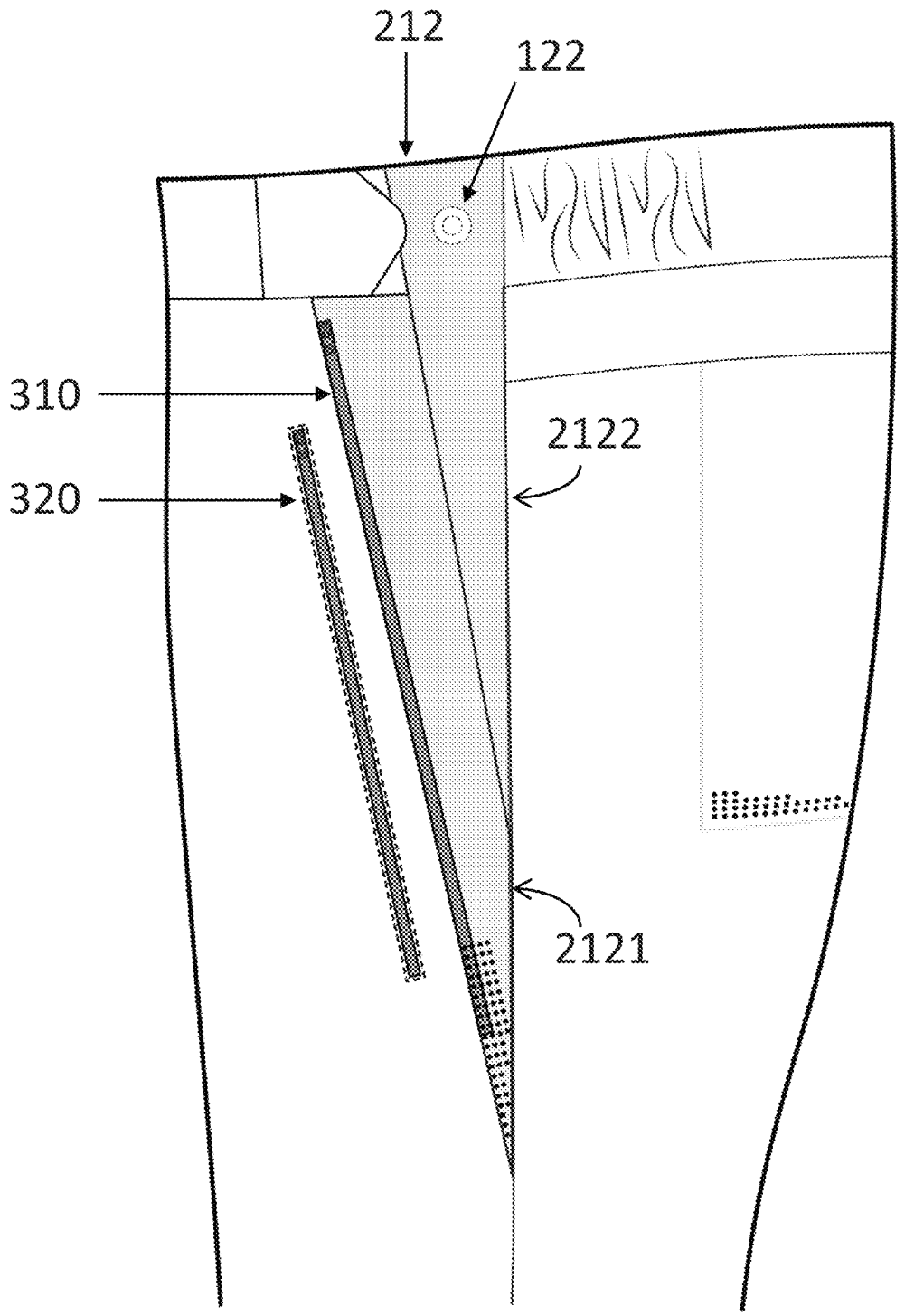
FIG. 7 schematically illustrates a lower garment with a side panel, in accordance with some embodiments.

FIGS. 6 and 7 schematically illustrate a side panel 212 that can be utilized in or integrated with any of the lower garments described herein. In some cases, the side panel 212 may be configured to provide an indirect coupling between the front waistband and the back waistband.

In some cases, the side panel may be configured as a non-elastic or inelastic panel. In some cases, the non-elastic or inelastic panel may not or need not be expandable or stretchable. In some cases, the non-elastic or inelastic panel may be configured as a stabilized anchoring point or region for other more elastic or stretchable components of the adjustable waistband.

In other cases, the side panel may be configured as an elastic panel. In some cases, the elastic panel may be configured to expand and/or stretch in order to adjust the circumferential length of the waistband assembly. In some cases, the elastic panel may comprise an elastic element extending along or across a portion of the side panel. In some cases, the elastic element may be configured to extend along or across an upper portion of the side panel. In some cases, the elastic element may be configured to extend along or across a subject's hips and/or waist. In some cases, the elastic element may comprise an encased elastic member. In other cases, the elastic element may not or need not comprise an encased elastic member.

Side Panel—Anterior/Posterior Sections

In some cases, the side panel 212 may comprise (i) an anterior section 2121 positioned entirely below a lower edge of the front waistband portion of the adjustable waistband. In some cases, the left or right side panel may comprise (ii) a posterior section 2122 configured to extend upwards and across the waistband assembly to an uppermost edge of the waistband.

In some cases, the anterior section 2121 and the posterior section 2122 may correspond to different sections of a single unitary panel. In other cases, the anterior section 2121 and the posterior section 2122 may be separate panels that are joined together to form a multi-piece panel.

In some cases, the anterior section 2121 may be positioned in front of the posterior section 2122 and closer towards the front center region of the garment than the posterior section 2122. In some cases, the posterior section 2122 may be positioned behind the anterior section 2121 and further away from the front center region of the garment than the anterior section 2121.

In some cases, the anterior section 2121 may be a different size and/or a different shape than the posterior section 2122. In some cases, the anterior section 2121 may have a different length, width, and/or height than the posterior section 2122. In some cases, the anterior section 2121 may have a greater length, width, and/or height than the posterior section 2122. In other cases, the posterior section 2122 may have a greater length, width, and/or height than the anterior section 2121. In some cases, the anterior section 2121 may have a different number of sides or edges than the posterior section 2122. In some cases, the anterior section 2121 may have a greater number of sides or edges than the posterior section 2122. In other cases, the posterior section 2122 may have a greater number of sides or edges than the anterior section 2121. In some cases, the anterior section 2121 may have four (4) sides or edges, and the posterior section 2122 may have three (3) sides or edges.

In some cases, the anterior section 2121 may comprise a first upper edge 213. In some cases, the posterior section 2122 may comprise a second upper edge 214 that is offset from the first upper edge 213. In some cases, the anterior section may comprise a first front edge 215. In some cases, the first front edge 215 may be configured to extend along a pocket opening of the lower garment. In some cases, the posterior section may comprise a second front edge 216 that is offset from the first front edge 215. In some cases, the posterior section may comprise a back edge 217 with (i) an upper portion attached or coupled to the back waistband and (ii) a lower portion attached or coupled to one or more rear panels of the lower garment.

In some cases, the side panel may comprise a first front edge portion attached to the front left or right waistband. In some cases, the side panel may comprise a second front edge portion extending under or below the first front edge portion. In some cases, the second front edge portion may be configured to extend along a pocket opening of the lower garment. In some cases, the side panel may comprise a first upper edge portion aligned with a lower edge of the front left or right waistband and a second upper edge portion aligned with an uppermost edge of the adjustable waistband. In some cases, the side panel may comprise a back edge portion attached to the back waistband and/or one or more rear panels of the lower garment.

In some cases, a portion of the anterior section 2121 of the side panel may be covered or overlapped by another layer of the lower garment. In some cases, a portion of the anterior section 2121 of the side panel may be covered or overlapped by a pocket welt of the lower garment. In some cases, a first portion of the anterior section 2121 may be hidden or concealed, and a second portion of the anterior section may be visible. In other cases, the entire anterior section 2121 may be hidden or concealed so that only the posterior section 2122 of the side panel is visible.

In some cases, the anterior section 2121 and the posterior section 2122 may comprise a same material. In other cases, the anterior section 2121 and the posterior section 2122 may comprise different materials. In some cases, the anterior section 2121 and/or the posterior section 2122 may include one or more elastic materials and/or one or more elastic regions. In some cases, the anterior section 2121 and/or the posterior section 2122 may include one or more non-elastic materials and/or one or more non-elastic regions.

Side Pockets

In some cases, the garment may comprise one or more side pockets. In some cases, the one or more side pockets may comprise a primary pocket. In some cases, the primary pocket may comprise a primary pocket bag configured to receive, hold, or retain one or more objects. In some cases, the primary pocket bag may be configured to at least partially cover a subject's hand when the subject places his or her hand in the primary pocket.

In some cases, the primary pocket may be accessible via a pocket opening extending along a front side edge of the anterior section of the left and/or right side panel. In some cases, the pocket opening may be opened and/or closed using an opening and/or closing mechanism 310. In some cases, the opening and/or closing mechanism may be provided along the front side edge of the anterior section of the side panel. In some cases, the opening and/or closing mechanism may be positioned along an edge of the pocket opening of the primary pocket. In some cases, the opening and/or closing mechanism may be positioned under a pocket welt of the lower garment.

In some cases, the one or more side pockets may comprise a secondary pocket. In some cases, the secondary pocket may be a pass-through pocket provided inside or within the primary pocket. In some cases, the pass-through pocket may comprise a secondary pocket bag that is separate from the primary pocket bag of the primary pocket. In some cases, the secondary pocket bag may be provided within or inside the primary pocket bag. In some cases, the pocket opening for the secondary pocket bag may be opened and/or closed using another opening and/or closing mechanism 320.

In some cases, the primary pocket may be opened and/or closed using a first opening and/or closing mechanism. In some cases, the secondary pocket may be opened and/or closed using a second opening and/or closing mechanism. In some cases, the first opening and/or closing mechanism may be a same type of mechanism as the second opening and/or closing mechanism. In other cases, the first opening and/or closing mechanism may be a different type of mechanism than the second opening and/or closing mechanism.

In some cases, the opening and/or closing mechanisms may include one or more mechanical fasteners. In some cases, the opening and/or closing mechanisms may include one or more sliding fasteners (e.g., zippers). Optionally or alternatively, the opening and/or closing mechanisms may include any of the other mechanical fasteners described elsewhere herein.

Pocket Welt

In some cases, the lower garment may have one or more pocket welts extending along or across the side pocket openings of the lower garment. In some cases, a portion of the outer shell layer of the lower garment may extend along or across the side pocket openings of the lower garment to form the pocket welts.

In some cases, the pocket welts may be configured to extend across and/or overlap a front edge portion of the side panels of the lower garment. In some cases, the pocket welts may be configured to extend across and/or overlap an anterior portion or section of the side panels of the lower garment.

Perforations

In some cases, select portions of the lower garment may be perforated to provide water drainage channels through the lower garment. In some cases, the water drainage channels may be configured to prevent water from building up in select portions of the lower garment.

In some cases, a portion of the pocket welt of the lower garment may be perforated. In some cases, a lower portion of the pocket welt may be perforated to drain water caught in or along the pocket welt. In some cases, the lower portion of the pocket welt may be perforated to drain water caught between the pocket welt and one or more other panels or layers of the lower garment. In some cases, the lower portion of the pocket welt may be perforated to drain water caught between the pocket welt and another panel or layer underlying the pocket welt. In some cases, the lower portion of the pocket welt may be perforated to drain water caught between the pocket welt and a side panel of the lower garment.

Figure 8:
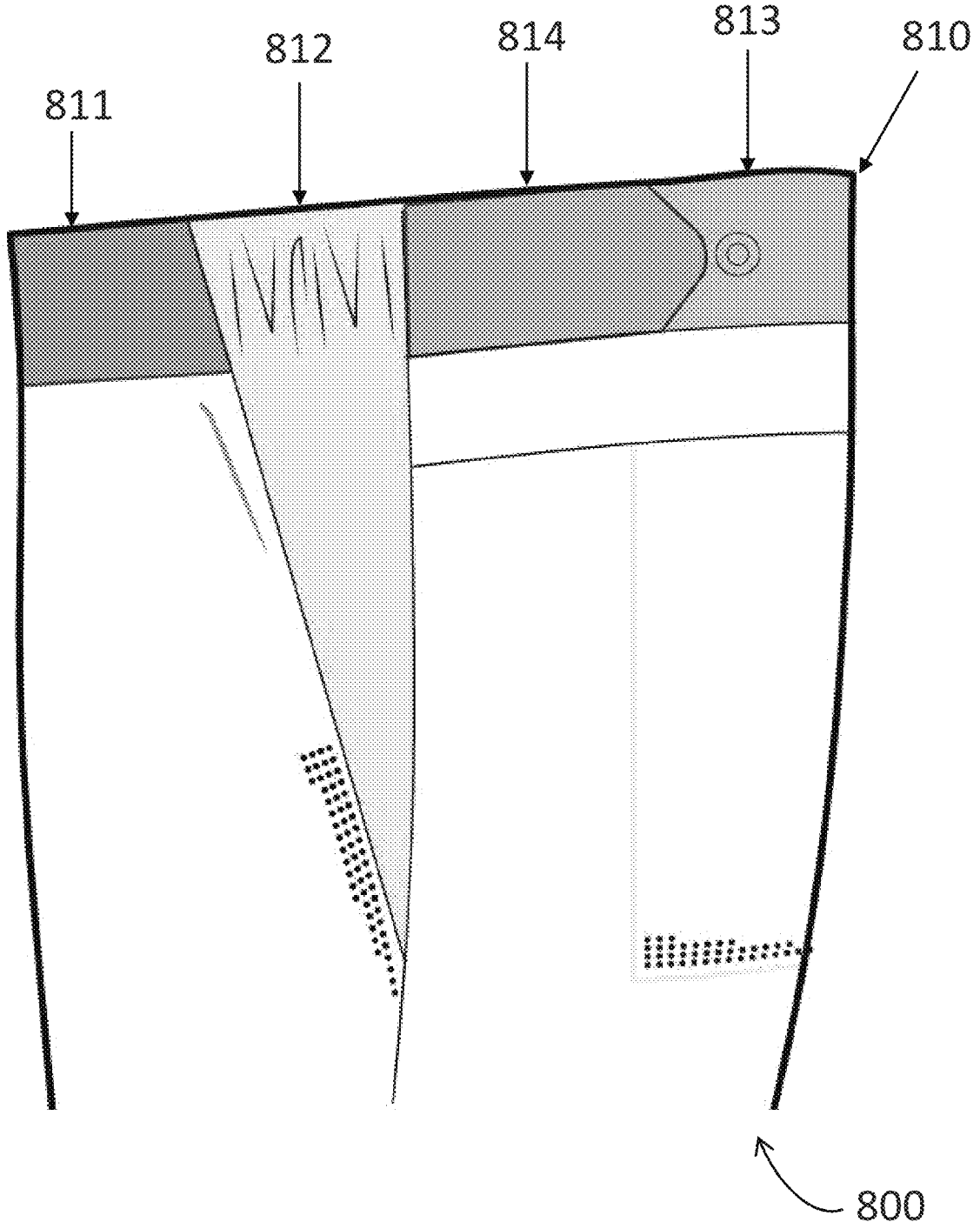
FIG. 8 schematically illustrates another example of a lower garment with an adjustable waistband construction, in accordance with some embodiments.

FIG. 8 schematically illustrates another example of an article of apparel with an adjustable construction. In some embodiments, the article of apparel may comprise a lower garment 800. In some cases, the lower garment 800 may comprise an adjustable waist band 810.

In some embodiments, the adjustable waist band 810 may comprise a front waistband portion 811. In some cases, the front waistband portion 811 may include a front left waistband and a front right waistband.

In some embodiments, the lower garment may comprise one or more side panels 812. In some cases, the one or more side panels 812 may be attached or coupled to the front left waistband and/or the front right waistband.

In some embodiments, the adjustable waist band 810 may further comprise a back waistband 813. In some cases, the back waistband 813 may be directly or indirectly attached or coupled to the one or more side panels 112.

In some embodiments, the adjustable waist band 810 may further comprise one or more extendable flaps 814. In some cases, the one or more extendable flaps 814 may be attached or coupled to the one or more side panels 812. In some cases, the one or more extendable flaps 814 may be attached or coupled to the back waistband 813. In some cases, the one or more extendable flaps 814 may be releasably coupled or secured to different portions or sections of the back waistband 813 to adjust the sizing of the waistband and/or the amount of tension in the waistband.

Front Waistband

Figure 9:
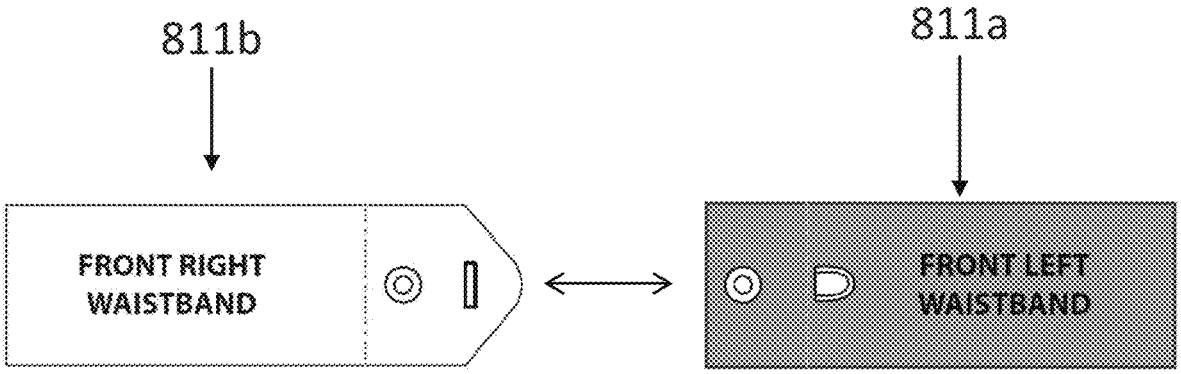
FIG. 9 schematically illustrates a front right and left waistband of the lower garment, in accordance with some embodiments.

Referring to FIG. 9, in some cases, the front waistband portion 811 of the adjustable waist band 810 may comprise a front left waistband 811*a*. In some cases, the front left waistband 811*a* may be configured to extend along a front left side of a subject's waist or lower body. In some cases, the front left waistband 811*a* may be configured to extend between a front center portion of the lower garment and a left side portion of the lower garment.

In some cases, the front waistband portion 811 of the adjustable waist band 810 may comprise a front right waistband 811*b*. In some cases, the front right waistband 811*b* may be configured to extend along a front right side of a subject's waist or lower body. In some cases, the front right waistband 811*b* may be configured to extend between a front center portion of the lower garment and a right side portion of the lower garment.

In some cases, the front left waistband 811*a* and the front right waistband 811*b* may be releasably coupled to each other using one or more fasteners. In some cases, the one or more fasteners may include (i) a fastener disposed on the front left waistband or the front right waistband. In some cases, the one or more fasteners may include (ii) another fastener disposed on the front right waistband or the front left waistband. In some cases, the fasteners may comprise a set of complementary fasteners. In some cases, the fasteners may include a button, a snap fit, a buckle, a hook, a loop, a hook and loop fastener (e.g., Velcro), a clip, a latch, a clasp, a ring, a zipper mechanism, a lacing system, or any other type of mechanical fastener.

Side Panels

Figure 10:
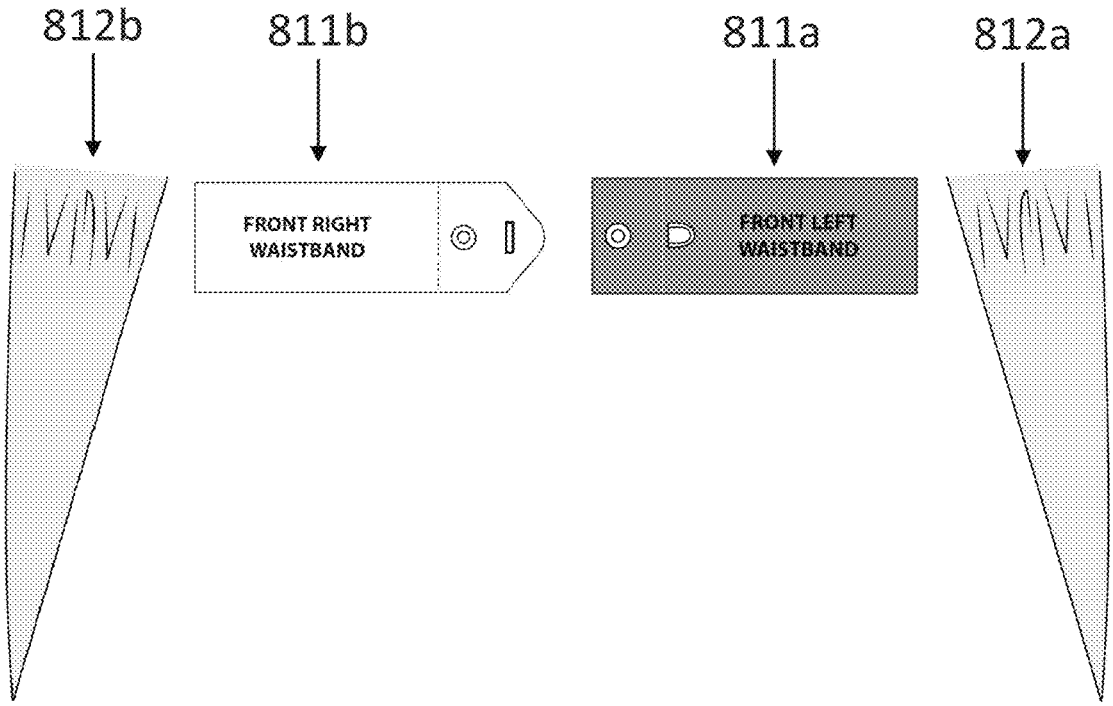
FIG. 10 schematically illustrates one or more side panels of the lower garment, in accordance with some embodiments.
Figure 11:
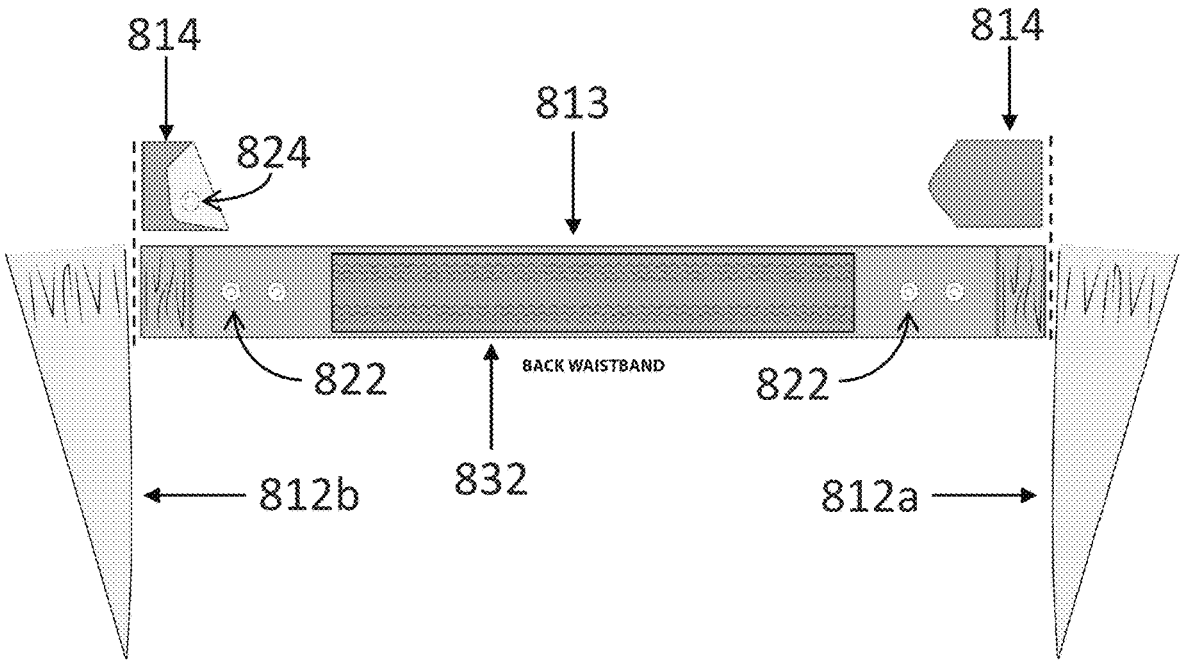
FIG. 11 schematically illustrates one or more extendable flaps that can be used to adjust the waistband, in accordance with some embodiments.

Referring to FIGS. 10 and 11, in some cases, the one or more side panels 812 may comprise a left side panel 812*a*. In some cases, the left side panel 812*a* may be provided between the front left waistband 811*a* and a left side edge of the back waistband 813. In some cases, the left side panel 812*a* may be provided between the front left waistband 811*a* and a first end of the one or more extendable flaps 814. In some cases, the one or more side panels 812 may comprise a right side panel 812*b*. In some cases, the right side panel 812*b* may be provided between the front right waistband 811*b* and a right side edge of the back waistband 813. In some cases, the right side panel 812*b* may be provided between the front right waistband 811*b* and a first end of the one or more extendable flaps 814.

In some cases, the left and/or right side panel may comprise an elastic material or one or more sections comprising an elastic material. In some cases, the left and/or right side panel may comprise an inelastic material or one or more sections comprising an inelastic material.

Back Waistband

Figure 12:
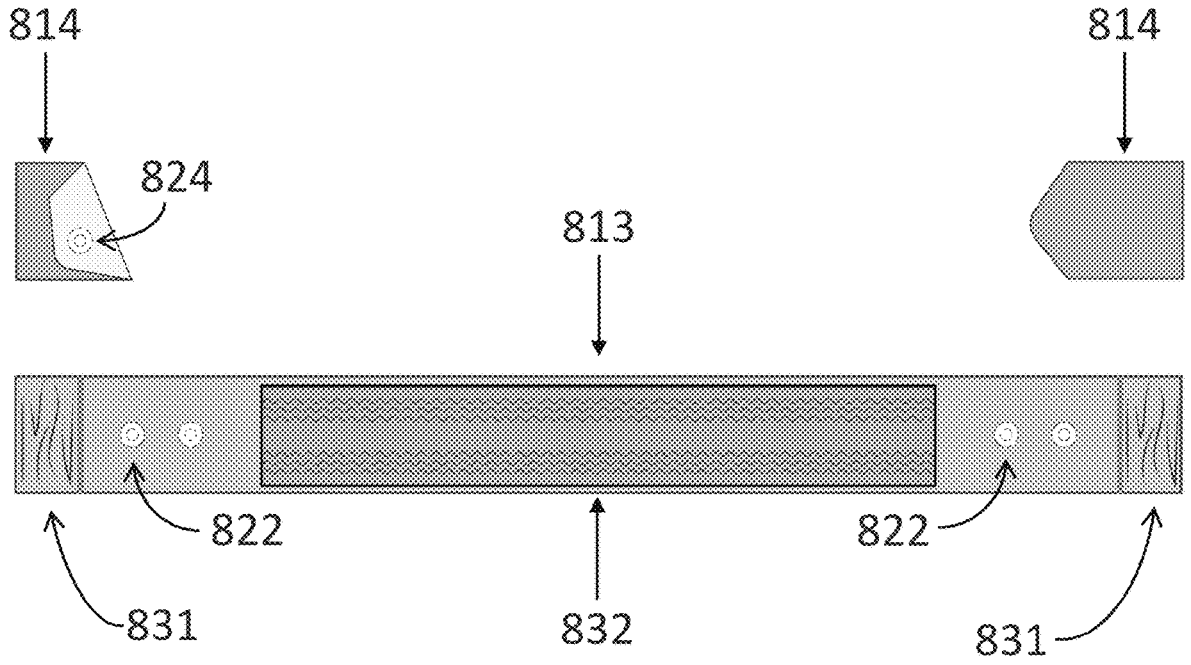
FIG. 12 schematically illustrates a back waistband with one or more fasteners, in accordance with some embodiments.

FIGS. 11 and 12 schematically illustrates a back waistband 813 of the adjustable waist band. In some cases, the back waistband 813 may be opposite the front left waistband and the front right waistband. In some cases, the back waistband 813 may be configured to extend along and/or around a back side of a subject's waist or lower body. In some cases, the back waistband 813 may be configured to extend between a left side portion and a right side portion of the lower garment. In some cases, the back waistband 113 may be configured to extend from a left side portion of the lower garment to a right side portion of the lower garment, or from a right side portion of the lower garment to a left side portion of the lower garment.

In some cases, the back waistband 813 may be directly or indirectly attached or coupled to the one or more side panels 812 of the lower garment. In some cases, a left side edge of the back waistband 813 may be attached or coupled to a back edge portion of the left side panel 812*a* of the lower garment. In some cases, a left side edge of the back waistband 813 may be attached or coupled to a first end of the one or more extendable flaps 814. In some cases, a right side edge of the back waistband 813 may be attached or coupled to a back edge portion of the right side panel 812*b* of the lower garment. In some cases, a right side edge of the back waistband 813 may be attached or coupled to a first end of the one or more extendable flaps 814.

In some cases, the back waistband 813 may comprise one or more elastic regions configured to stretch and/or expand under tension. In some cases, the one or more elastic regions may include one or more encased elastic elements 831 arranged along the left and/or right side edges of the back waistband 813. In some cases, the back waistband 813 may comprise one or more non-elastic regions configured to resist stretching or expansion under tension.

In some cases, the back waistband 813 may comprise an elastic gripper element 832. In some cases, the elastic gripper element 832 may be disposed along an inner surface portion of the back waistband 813. In some cases, the elastic gripper element 832 may comprise a material that can frictionally engage another article of apparel worn by the subject in order to control or limit (i) a movement of the waistband or the lower garment relative to the other article of apparel or (ii) a movement of the other article of apparel relative to the waistband or the lower garment.

In some cases, one or more fasteners 822 may be provided on the back waistband 813. In some cases, the one or more fasteners 822 may be disposed between the one or more encased elastic elements 831 and the elastic gripper element 832. In some cases, the one or more fasteners 822 may be configured to engage another fastener 824 provided along the underside of the one or more extendable flaps 814.

Extendable Flaps

In some cases, the adjustable waist band 810 may comprise one or more extendable flaps 814. In some cases, the one or more extendable flaps 814 may comprise (i) a first end attached to the left or right side panel and (ii) a second end that is securable to the back waistband 813. In some cases, the one or more extendable flaps 814 may comprise (i) a first end attached to a first portion of the back waistband 813 and (ii) a second end that is securable to a second portion of the back waistband 813.

In some cases, the one or more extendable flaps 814 may comprise (i) a first end that is fixed to a back edge portion of the left and/or right side panels and (ii) a second end that is securable to the back waistband 813. In other cases, the one or more extendable flaps 814 may comprise (i) a first end that is fixed to a left and/or right side edge of the back waistband 813 and (ii) a second end that is securable to another part of the back waistband 813.

In some cases, the second end of the one or more extendable flaps 814 may be releasably coupled to different portions of the back waistband 813 to adjust the sizing of the waistband and/or the amount of tension in the waistband. In some cases, the waistband may have a first length or a first amount of tension when the second end of the one or more extendable flaps is secured to a first portion of the back waistband. In some cases, the waistband may have a second length or a second amount of tension when the second end of the one or more extendable flaps is secured to a second portion of the back waistband.

In some cases, the second end of the one or more extendable flaps 814 may comprise a fastener 824. In some cases, the fastener 824 may be positioned along an underside of the one or more extendable flaps 814. In some cases, the fastener 824 may be positioned towards the second end of the extendable flaps. In some cases, the fastener 824 may be configured to engage one or more other fasteners provided on the back waistband. In some cases, the fastener 824 may be configured to engage another fastener provided on the back waistband.

In some cases, the one or more extendable flaps may comprise an elastic material or one or more elastic sections or regions. In some cases, the one or more extendable flaps may comprise an inelastic material or one or more inelastic sections or regions. In some cases, the one or more extendable flaps may comprise one or more elastic materials and/or one or more inelastic materials. In some cases, the one or more extendable flaps may comprise one or more elastic sections or regions and/or one or more inelastic sections or regions.

Waist Band Adjustment

The adjustable waistband constructions shown in FIGS. 8-12 may be manipulated by a subject to adjust the sizing of the waistband and/or the amount of tension in the waistband, so that the lower garment fits comfortably around the subject's waist and lower body. In some cases, the front left waistband and the front right waistband may be secured together around the subject's waist (e.g., using a first set of fasteners) to initially secure the lower garment around the subject's waist or lower body. In some cases, the ends of the extendable flaps may be detachably coupled to a first portion of the back waistband (e.g., using a second set of fasteners). In some cases, the ends of the extendable flaps may be released from the first portion of the back waistband by disengaging the second set of fasteners, so that the extendable flaps can be extended towards a second portion of the back waistband. In some cases, the extendable flaps may be extended towards the second portion of the back waistband and releasably coupled to one or more other fasteners provided on the second portion of the back waistband. In some cases, when the extendable flaps are secured to the one or more other fasteners on the second portion of the back waistband, the circumferential length of the adjustable waistband may be decreased. In some cases, when the extendable flaps are secured to the one or more other fasteners on the second portion of the back waistband, the adjustable waistband may be more tightly secured around the subject's waist or lower body.

In some cases, when a subject wishes to (i) increase the circumferential length of the adjustable waistband or (ii) release the tension in the waistband, the subject may disengage the fasteners coupling the extendable flaps to the one or more other fasteners on the second portion of the back waistband. Once the extendable flaps are released, the free ends of the extendable flaps may be repositioned towards one or more fasteners provided on the first portion of the back waistband, and the fasteners provided along the underside of the extendable flaps may be detachably coupled to the fasteners provided on the first portion of the back waistband. In some cases, when the extendable flaps are secured to the first and/or second portion(s) of the back waistband, the upper and lower edges of the extendable flaps may be neatly arranged along or parallel to the upper and/or lower edges of the back waistband to preserve the aesthetic profile of the adjustable waistband. In some cases, the extendable flaps may be configured to remain in a fixed position and/or a fixed orientation relative to the rest of the waistband when the extendable flaps are secured to the back waistband. In some cases, securing the extendable flaps to the back waistband may prevent the extendable flaps from hanging downwards and moving around unnecessarily when the flaps are not in use. In some cases, when the extendable flaps are not in use, the extendable flaps may be secured to the back waistband so that the extendable flaps are positioned out of the way and do not interfere with the subject's mobility, comfort, or ability to execute various different actions or movements.

Side Panel Configurations

Figure 13:
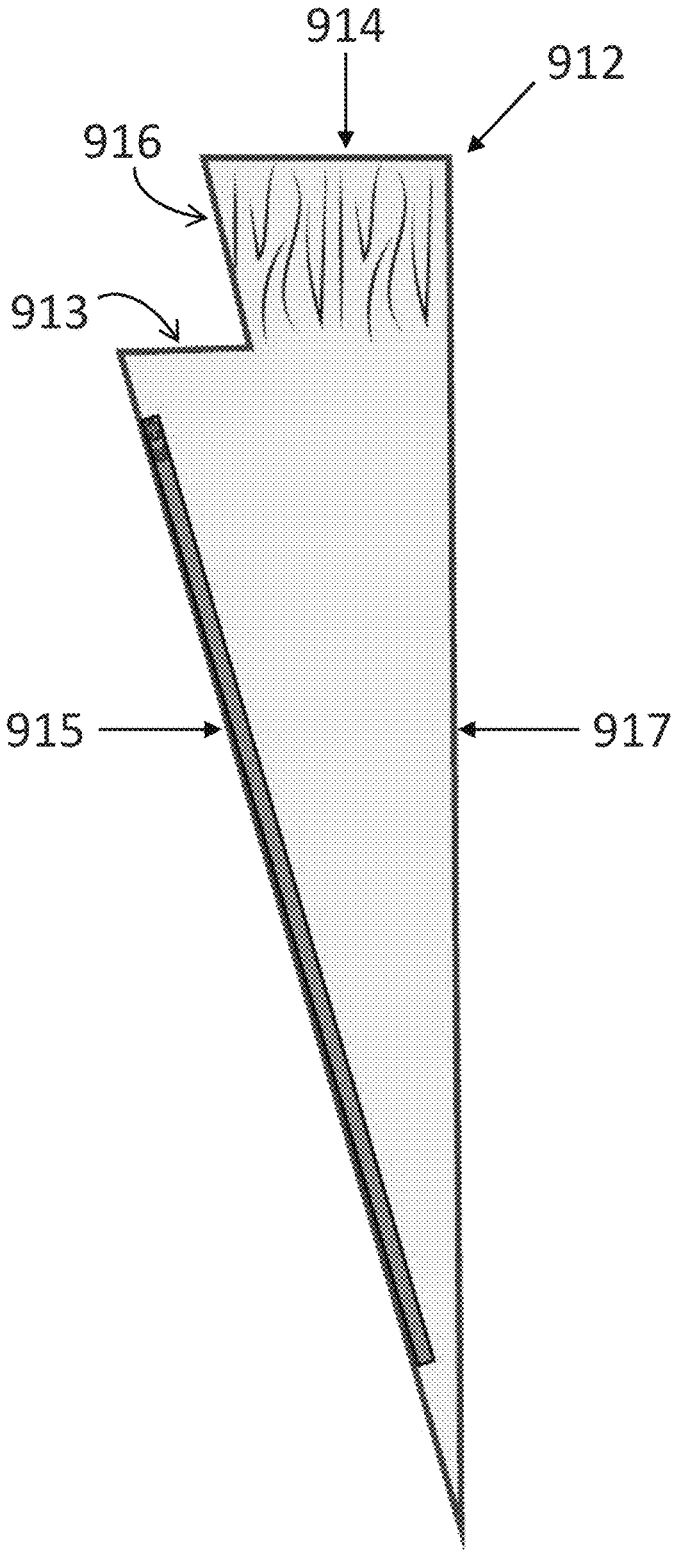
FIG. 13 schematically illustrates a detailed view of a side panel construction for a lower garment, in accordance with some embodiments.
Figure 14:
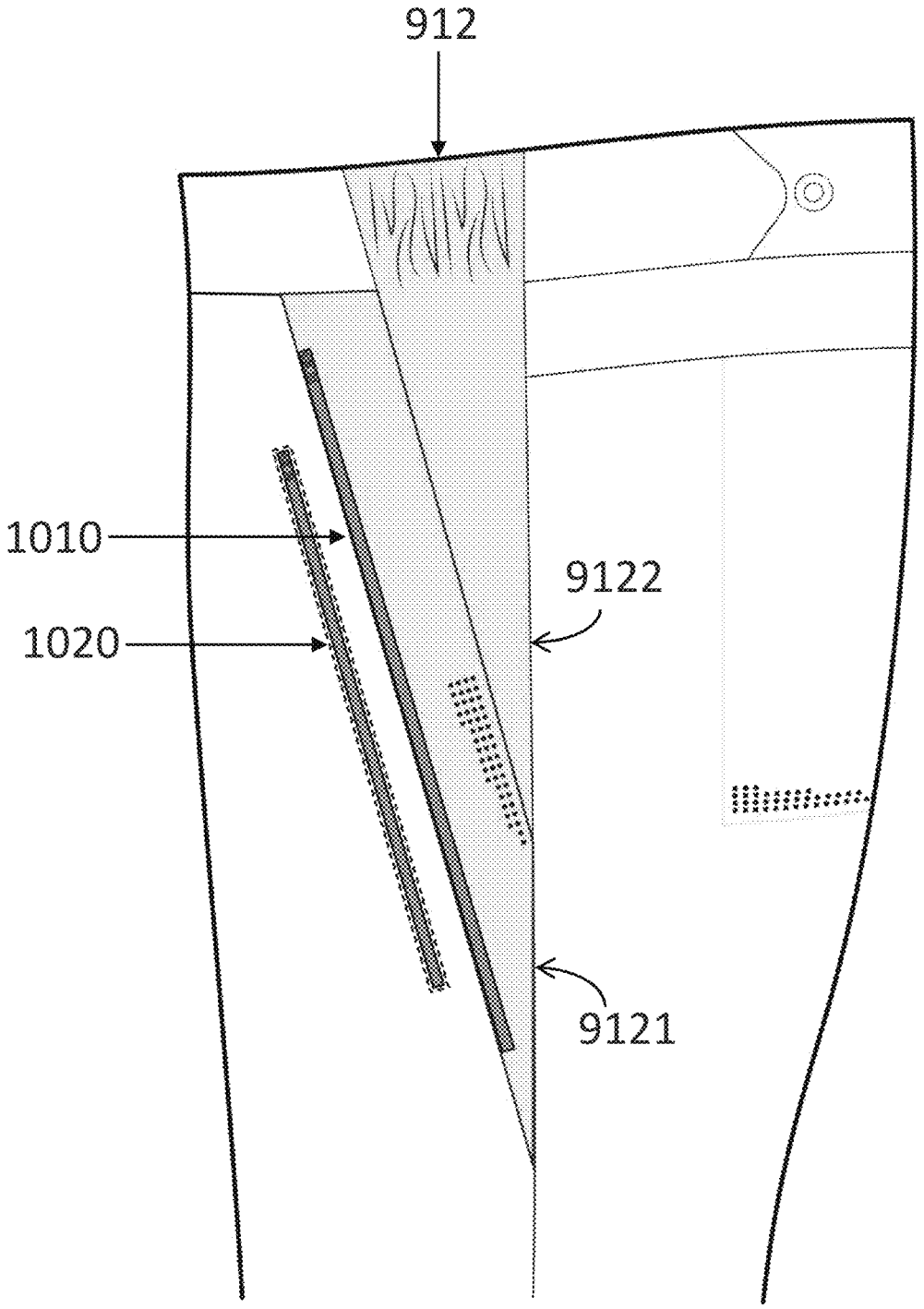
FIG. 14 schematically illustrates another lower garment with a side panel, in accordance with some embodiments.

FIGS. 13 and 14 schematically illustrate a side panel 912 that can be utilized in or integrated with any of the lower garments described herein. In some cases, the side panel 912 may be configured to indirectly couple (i) the front waistband to (ii) a left and/or right side edge of the back waistband and/or (iii) a first end of the one or more extendable flaps.

In some cases, the side panel may be configured as an elastic panel. In some cases, the elastic panel may be configured to expand and/or stretch in order to adjust the circumferential length of the waistband assembly. In some cases, the elastic panel may comprise an elastic element extending along or across a portion of the side panel. In some cases, the elastic element may be configured to extend along or across an upper portion of the side panel. In some cases, the elastic element may be configured to extend along or across a subject's hips and/or waist. In some cases, the elastic element may comprise an encased elastic member. In other cases, the elastic element may not or need not comprise an encased elastic member.

In other cases, the side panel may be configured as a non-elastic or inelastic panel. In some cases, the non-elastic or inelastic panel may not or need not be expandable or stretchable. In some cases, the non-elastic or inelastic panel may be configured as a stabilized anchoring point or region for other more elastic or stretchable components of the adjustable waistband.

Side Panel-Anterior/Posterior Sections

In some cases, the side panel 912 may comprise (i) an anterior section 9121 positioned entirely below a lower edge of the front waistband portion of the adjustable waistband. In some cases, the left or right side panel may comprise (ii) a posterior section 9122 configured to extend upwards and across the waistband assembly to an uppermost edge of the waistband.

In some cases, the anterior section 9121 and the posterior section 9122 may correspond to different sections of a single unitary panel. In other cases, the anterior section 9121 and the posterior section 9122 may be separate panels that are joined together to form a multi-piece panel.

In some cases, the anterior section 9121 may be positioned in front of the posterior section 9122 and closer towards the front center region of the garment than the posterior section 9122. In some cases, the posterior section 9122 may be positioned behind the anterior section 9121 and further away from the front center region of the garment than the anterior section 9121.

In some cases, the anterior section 9121 may be a different size and/or a different shape than the posterior section 9122. In some cases, the anterior section 9121 may have a different length, width, and/or height than the posterior section 9122. In some cases, the anterior section 9121 may have a greater length, width, and/or height than the posterior section 9122. In other cases, the posterior section 9122 may have a greater length, width, and/or height than the anterior section 9121. In some cases, the anterior section 9121 may have a different number of sides or edges than the posterior section 9122. In some cases, the anterior section 9121 may have a greater number of sides or edges than the posterior section 9122. In other cases, the posterior section 9122 may have a greater number of sides or edges than the anterior section 9121. In some cases, the anterior section 9121 may have four (4) sides or edges, and the posterior section 9122 may have three (3) sides or edges.

In some cases, the anterior section 9121 may comprise a first upper edge 913. In some cases, the posterior section 9122 may comprise a second upper edge 914 that is offset from the first upper edge 913. In some cases, the anterior section may comprise a first front edge 915. In some cases, the first front edge 915 may be configured to extend along a pocket opening of the lower garment. In some cases, the posterior section may comprise a second front edge 916 that is offset from the first front edge 915. In some cases, the posterior section may comprise a back edge 917 with (i) an upper portion attached or coupled to the back waistband and/or the one or more extendable flaps 814 and (ii) a lower portion attached or coupled to one or more rear panels of the lower garment.

In some cases, the side panel may comprise a first front edge portion attached to the front left or right waistband. In some cases, the side panel may comprise a second front edge portion extending under or below the first front edge portion. In some cases, the second front edge portion may be configured to extend along a pocket opening of the lower garment. In some cases, the side panel may comprise a first upper edge portion aligned with a lower edge of the front left or right waistband and a second upper edge portion aligned with an uppermost edge of the adjustable waistband. In some cases, the side panel may comprise a back edge portion attached to the back waistband, the one or more extendable flaps, and/or one or more rear panels of the lower garment.

In some cases, a portion of the anterior section 9121 of the side panel may be covered or overlapped by another layer of the lower garment. In some cases, a portion of the anterior section 9121 of the side panel may be covered or overlapped by a pocket welt of the lower garment. In some cases, a first portion of the anterior section 9121 may be hidden or concealed, and a second portion of the anterior section may be visible. In other cases, the entire anterior section 9121 may be hidden or concealed so that only the posterior section 9122 of the side panel is visible.

In some cases, the anterior section and the posterior section may comprise a same material. In other cases, the anterior section and the posterior section may comprise different materials. In some cases, the anterior section and/or the posterior section may include one or more elastic materials and/or one or more elastic regions. In some cases, the anterior section and/or the posterior section may include one or more non-elastic materials and/or one or more non-elastic regions.

Side Pockets

In some cases, the garment may comprise one or more side pockets. In some cases, the one or more side pockets may comprise a primary pocket with a primary pocket bag as described elsewhere herein.

In some cases, the primary pocket may be accessible via a pocket opening extending along a front side edge of the anterior section of the left and/or right side panel. In some cases, the pocket opening may be opened and/or closed using an opening and/or closing mechanism 1010. In some cases, the opening and/or closing mechanism may be provided along the front side edge of the anterior section of the side panel. In some cases, the opening and/or closing mechanism may be positioned along an edge of the pocket opening of the primary pocket. In some cases, the opening and/or closing mechanism may be positioned under a pocket welt of the lower garment.

In some cases, the one or more side pockets may comprise a secondary pocket. In some cases, the secondary pocket may be a pass-through pocket. In some cases, the pass-through pocket may comprise a secondary pocket bag as described elsewhere herein. In some cases, the pocket opening for the secondary pocket bag may be opened and/or closed using another opening and/or closing mechanism 1020.

In some cases, the primary pocket may be opened and/or closed using a first opening and/or closing mechanism. In some cases, the secondary pocket may be opened and/or closed using a second opening and/or closing mechanism. In some cases, the first opening and/or closing mechanism may be a same type of mechanism as the second opening and/or closing mechanism. In other cases, the first opening and/or closing mechanism may be a different type of mechanism than the second opening and/or closing mechanism.

In some cases, the opening and/or closing mechanisms may include one or more mechanical fasteners. In some cases, the opening and/or closing mechanisms may include one or more sliding fasteners (e.g., zippers). Optionally or alternatively, the opening and/or closing mechanisms may include any of the other mechanical fasteners described elsewhere herein.

Pocket Welt

In some cases, the lower garment may have one or more pocket welts extending along or across the side pocket openings of the lower garment. In some cases, a portion of the outer shell layer of the lower garment may extend along or across the side pocket openings of the lower garment to form the pocket welts.

In some cases, the pocket welts may be configured to extend across and/or overlap a front edge portion of the side panels of the lower garment. In some cases, the pocket welts may be configured to extend across and/or overlap an anterior portion or section of the side panels of the lower garment.

Perforations

In some cases, select portions of the lower garment may be perforated to provide water drainage channels through the lower garment. In some cases, the water drainage channels may be configured to prevent water from building up in select portions of the lower garment.

In some cases, a portion of the pocket welt of the lower garment may be perforated. In some cases, a lower portion of the pocket welt may be perforated to drain water caught in or along the pocket welt. In some cases, the lower portion of the pocket welt may be perforated to drain water caught between the pocket welt and one or more other panels or layers of the lower garment. In some cases, the lower portion of the pocket welt may be perforated to drain water caught between the pocket welt and another panel or layer underlying the pocket welt. In some cases, the lower portion of the pocket welt may be perforated to drain water caught between the pocket welt and a side panel of the lower garment.

Outer Shell

In some embodiments, the lower garments described herein may comprise an outer shell layer that is directly exposed to an external environment. In some cases, the outer shell layer may overlie one or more other panels or layers of the lower garment.

Water and Weather Resistance

In some cases, the outer shell layer may comprise a durable material. In some cases, the durable material may comprise a water repellant or water resistant material. In some cases, the durable material may comprise a weather-resistant material.

In some cases, the outer shell layer may be water repellant. In some embodiments, one or more hydrophobic coatings may be applied to provide a durable water repellent (DWR) layer which repels any precipitation contacting the external surface of the outer shell layer. In some embodiments, the outer shell layer may be a water-resistant fabric that is substantially impervious to water.

In some cases, the outer shell layer may be weather resistant. In some cases, the weather resistant outer shell layer may be generally resistant to water and/or wind. In some cases, the weather-resistant outer shell layer may be substantially impervious to one or more fluids in a liquid phase, a gaseous phase, or a vapor phase. In some cases, the weather-resistant outer shell layer may be substantially impervious to wind and/or air currents. In some cases, the weather-resistant outer shell layer may also be substantially impervious to water and/or other precipitation.

In some cases, the outer shell layer may be impermeable or semi-permeable to solids, liquids, vapors, and/or gases. In some cases, the outer shell layer may be selectively permeable or semi-permeable in different directions through the outer shell layer. In some cases, the outer shell layer may be selectively permeable in a first direction from an inner side of the outer shell layer (i.e., a side of the outer shell layer facing inwards towards the subject's body) to an outer side of the outer shell layer (i.e., a side of the outer shell layer that is directly exposed to an external environment) in order to (1) enhance the breathability of the garment and (2) expel or remove any unwanted moisture inside or within the garment (e.g., due to condensation of water vapor and/or perspiration). In some cases, the outer shell layer may be impermeable or semi-permeable in a second direction from the outer side of the outer shell layer to the inner side of the outer shell layer in order to prevent a movement of precipitation (e.g., drizzle, rain, sleet, snow, ice pellets, and/or hail) into an interior region of the articles disclosed herein.

Seams

The garments described herein may be assembled or constructed by joining various components together using one or more seams. In some cases, the one or more seams may be stitchless bonded seams. In some cases, the one or more seams may be 100% waterproof.

Additional Notes

While various embodiments of the invention are shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

One of skill in the art will appreciate that these articles are provided for illustrative purposes, and that other articles may be employed to perform the functionalities disclosed herein without departing from the scope of the disclosure. Moreover, while different examples and embodiments may be described separately, such embodiments and examples may be combined with one another to implement the technology described herein. One skilled in the art will recognize other embodiments or improvements that are within the scope and spirit of the present technology. Therefore, the specific structure, acts, or media are disclosed only as illustrative embodiments. The scope of the present disclosure is further represented below in the following claims.

What is claimed is:

1. An article comprising:

a lower garment comprising:

(i) a front left waistband and a front right waistband;

(ii) a back waistband;

(iii) a left side panel provided between the front left waistband and a left side edge of the back waistband;

(iv) a right side panel provided between the front right waistband and a right side edge of the back waistband; and (v) one or more extendable flaps with a first end attached to the front left or right waistband and a second end that is securable to the left or right side panel, wherein the left or right side panel comprises a single unitary panel with an anterior section positioned entirely below the front left or right waistband and a posterior section extending below a lower edge of the front left or right waistband and a lower edge of the back waistband, and wherein the posterior section comprises an upper portion that extends to an uppermost edge of the lower garment and a lower portion that is attached to one or more rear panels of the lower garment.

2. The article of claim 1, further comprising a first fastener provided on the left side panel or the right side panel.

3. The article of claim 2, wherein the second end of the one or more extendable flaps comprises a second fastener configured to engage the first fastener.

4. The article of claim 3, wherein the second fastener is positioned along an underside of the one or more extendable flaps.

5. The article of claim 3, wherein the second end of the one or more extendable flaps is securable along the front left or right waistband.

6. The article of claim 1, wherein the left or right side panel comprises a first front edge portion attached to the front left or right waistband and a second front edge portion extending along a pocket opening of the lower garment.

7. The article of claim 6, wherein the left or right side panel comprises a back edge portion attached to the back waistband and one or more rear panels of the lower garment.

8. The article of claim 1, wherein the anterior section comprises a first upper edge and the posterior section comprises a second upper edge that is offset from the first upper edge.

9. The article of claim 8, wherein the first upper edge is aligned with the lower edge of the front left waistband or the front right waistband.

10. The article of claim 8, wherein the anterior section comprises a first front edge and the posterior section comprises a second front edge that is offset from the first front edge.

11. The article of claim 10, wherein the first upper edge is configured to extend from the first front edge to the second front edge.

12. The article of claim 10, wherein the lower garment further comprises one or more side pockets with pocket openings disposed along the first front edge of the anterior section.

13. The article of claim 12, wherein the lower garment further comprises a fastener configured to open and/or close one of said pocket openings.

14. The article of claim 1, wherein the left or right side panel comprises an elastic material.

15. The article of claim 1, wherein the left or right side panel comprises an inelastic material.

16. The article of claim 1, wherein the one or more extendable flaps comprise an elastic material.

17. The article of claim 1, wherein the one or more extendable flaps comprise an inelastic material.

18. The article of claim 1, wherein the back waistband comprises one or more elastic regions encased within the back waistband.

19. The article of claim 1, wherein the back waistband comprises a gripper elastic portion provided along an inner surface of the back waistband.

* * * * *